US007150452B2

(12) United States Patent
Terao et al.

(10) Patent No.: US 7,150,452 B2
(45) Date of Patent: Dec. 19, 2006

(54) WAITING TRAY FOR SHEET PROCESSING TRAY

(75) Inventors: Yasunobu Terao, Tagata-gun (JP); Reiji Murakami, Yokohama (JP); Tokihiko Ise, Tagata-gun (JP); Hajime Yamamoto, Mishima (JP); Hiroyuki Taki, Tagata-gun (JP); Chiaki Iizuka, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,148

(22) Filed: Dec. 10, 2004

(65) Prior Publication Data

US 2006/0066022 A1 Mar. 30, 2006

(30) Foreign Application Priority Data

Sep. 28, 2004 (JP) ..... 2004-282214

(51) Int. Cl.
*B65H 37/04* (2006.01)

(52) U.S. Cl. ..... 270/58.14; 270/58.11; 270/58.08; 270/58.18; 399/124; 399/410

(58) Field of Classification Search ..... 270/58.08, 270/58.11, 58.12, 58.14, 58.18; 271/189, 271/190, 191, 192; 399/410, 107, 110, 124
See application file for complete search history.

(56) References Cited

U.S. PATENT DOCUMENTS

| | | | | |
|---|---|---|---|---|
| 4,473,425 | A | | 9/1984 | Baughman et al. |
| 4,611,741 | A | | 9/1986 | Wilson |
| 4,794,859 | A | | 1/1989 | Huseby et al. |
| 4,898,374 | A | | 2/1990 | Vermaat |
| 5,098,074 | A | | 3/1992 | Mandel et al. |
| 5,112,034 | A | | 5/1992 | Uto et al. |
| 5,282,611 | A | | 2/1994 | Ueda et al. |
| 5,285,249 | A | | 2/1994 | Mahoney |
| 5,289,251 | A | | 2/1994 | Mandel et al. |
| 5,435,544 | A | | 7/1995 | Mandel |
| 5,451,037 | A | * | 9/1995 | Lundstrom ..... 270/1.03 |
| 5,628,502 | A | | 5/1997 | Amarakoon |
| 5,676,517 | A | | 10/1997 | Lotz |
| 5,709,376 | A | | 1/1998 | Ushirogata |

(Continued)

FOREIGN PATENT DOCUMENTS

JP 62-008965 A 1/1987

(Continued)

OTHER PUBLICATIONS

U.S. Appl. No. 11/008,122, filed Dec. 10, 2004, Sasahara.

(Continued)

*Primary Examiner*—Patrick Mackey
(74) *Attorney, Agent, or Firm*—Foley & Lardner LLP

(57) ABSTRACT

A waiting tray is provided in a sheet-conveying path and holds sheets if the sheets need to be post-processed. A processing tray receives sheets conveyed from the waiting tray. It may receive sheets conveyed through the sheet-conveying path and coming not via the waiting tray, before the sheets are post-processed. A conveying mechanism is provided, which causes the sheets to fall, due to gravity, from the waiting tray onto a processing tray. A sheet-aligning mechanism aligns the sheets on the processing tray, at their transverse edges and longitudinal edges. On the processing tray, the sheets are post-processed, forming a bundle. The conveying mechanism conveys the bundle of sheets to a storage tray. A top cover is provided above the waiting tray and can be opened and closed.

20 Claims, 13 Drawing Sheets

U.S. PATENT DOCUMENTS

| | | | | |
|---|---|---|---|---|
| 5,934,140 | A | 8/1999 | Jackson et al. | |
| 5,961,274 | A | 10/1999 | Bors | |
| 5,971,384 | A | 10/1999 | Asao | |
| 6,065,747 | A | 5/2000 | Khovaylo et al. | |
| 6,092,948 | A | 7/2000 | Altfather | |
| 6,231,039 | B1 | 5/2001 | Chung | |
| 6,330,999 | B1 * | 12/2001 | Coombs et al. | 270/58.16 |
| 6,336,630 | B1 | 1/2002 | Holtman et al. | |
| 6,354,059 | B1 | 3/2002 | Yoshie et al. | |
| 6,450,934 | B1 | 9/2002 | Coombs | |
| 6,641,129 | B1 | 11/2003 | Ogita et al. | |
| 6,671,492 | B1 | 12/2003 | Mimura et al. | |
| 6,698,744 | B1 | 3/2004 | Yamada et al. | |
| 6,712,349 | B1 | 3/2004 | Watanabe | |
| 6,722,646 | B1 | 4/2004 | Sekiyama et al. | |
| 6,733,006 | B1 | 5/2004 | Kobayashi et al. | |
| 6,819,906 | B1 | 11/2004 | Herrmann et al. | |
| 6,824,128 | B1 | 11/2004 | Nagata et al. | |
| 6,910,686 | B1 | 6/2005 | Awano | |
| 6,928,259 | B1 | 8/2005 | Sakuma | |
| 2002/0047233 | A1 | 4/2002 | Coombs et al. | |
| 2002/0163119 | A1 | 11/2002 | Kawata | |
| 2004/0113348 | A1 | 6/2004 | Awano | |
| 2004/0126163 | A1 | 7/2004 | Asami et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 6-99070 | B2 | 12/1994 |
| JP | 11-157724 | A | 6/1999 |
| JP | 2001-089009 | A | 4/2001 |
| JP | 2001-125459 | A | 5/2001 |
| JP | 2003-081517 | A | 3/2003 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008.132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao et al., Notice of Allowance and Fee(s) Due, U.S. Appl. No. 11/008,132, filed Oct. 6, 2005, 9 pages.
Y. Terao et al., Notice of Allowance and Fee(s) Due, U.S. Appl. No. 11/008,124, filed Sep. 30, 2005, 9 pages.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,224, filed Nov. 21, 2005, 10 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,392, filed Dec. 14, 2005, 9 pages.
Y. Terao et al., U.S. PTO Office, U.S. Appl. No. 11/008,294, filed Dec. 13, 2005, 9 pages.
Y. Terao et al., U.S. PTO Office, U.S. Appl. No. 11/008,299, filed Dec. 13, 2005, 9 pages.
Y. Terao et al., U.S. PTO Office, U.S. Appl. No. 11/008,349, filed Dec. 13, 2005, 9 pages.
Y. Terao et al., U.S. PTO Office, U.S. Appl. No. 11/008,567, filed Dec. 13, 2005, 9 pages.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,350, filed Jan. 26, 2006, 12 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. PTO Notice of Allowance, U.S. Appl. No. 11/085,243, filed Jan. 5, 2006, with attached Notice of Withdrawal from issue dated Jan. 10, 2006, 10 pgs.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 2, 2006, 7 pgs.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed May 2, 2005, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006 13 pages.

Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr. 26, 2006, 10 pages.
Y. Terao et al., Notice of Allowance and Fee(s) Due, Serial No. 11/008,251, Jun. 26, 2006, 10 pages.
Y. Terao et al., Notice of Allowance and Fee(s) Due, Serial No. 11/085,241, Jun. 26, 2006, 10 pages.
Y. Terao et al., Notice of Allowance and Fee(s) Due, Serial No. 11/085,243, Jun. 26, 2006, 10 pages.
Y. Terao et al., U.S. PTO Office Action, Serial No. 11/008,295, Jun. 23, 2006, 14 pgs.
Y. Terao et al., U.S. PTO Office Action, Serial No. 11/008,132, Jun. 9, 2006, with attached Notice of Withdrawal from Issue dated May 30, 2006, 11 pgs.
Y. Terao et al., U.S. PTO Office Action, Serial No. 11/008,350, Jul. 6, 2006, 12 pgs.
Y. Terao et al., U.S. PTO Office Action, Serial No. 11/085,247, Jul. 13, 2006, 14 pgs.
Y. Terao et al., U.S. PTO Office Action, Serial No. 11/085,248, Jul. 5, 2006, 15 pgs.
Y. Terao et al., U.S. PTO Office Action, Ser. No. 11/085,256, Jul. 13, 2006, 13 pgs.
Y. Terao et al., U.S. PTO Office Action, Ser. No 11/085,625, Jul. 28, 2006, 13 pgs.
Y. Terao, et al., Notice of Allowance and Fee(s) Du, Ser. No. 11/008,122, Jul. 26, 2006, 8 pgs.
Y. Terao et al., U.S. PTO Office Action, Ser. No. 11/008,381, Aug. 23, 2005, 17 pages.
Y. Terao et al., U.S. PTO Office Action, Ser. No. 11/008,567, Aug. 21, 2006, 14 pages.
Y. Terao, et al., Notice of Allowance and Fee(s) Due, Serial No. 11/008,222, Aug. 31, 2006, 12 pgs.
Y. Terao, et al., Notice of Allowance and Fee(s) Due, Ser. No. 11/008/,299, Sep. 6, 2006, 9 pgs.
Y. Terao et al., Notice of Allowance and Fee(s) Due, Serial No. 11/085,244, Jul. 13, 2006, 10 pages.
Y. Terao et al., U.S. PTO Office Action, Serial No. 11/085,226, Jul. 20, 2006, 12 pages.
Y. Terao et al., U.S. PTO Office Action, Serial No. 11/085,227, Aug. 11, 2006, 15 pages.
Y. Terao et al., U.S. PTO Office Action, Serial No. 11/085,240, Aug. 2, 2006, 15 pages.
Y. Terao et al., U.S. PTO Office Action. Serial No. 11/008,145, Jun. 30, 2006, 6 pgs.
Y. Terao et al., U.S. PTO Office Action, Serial No. 11/008,147, Jul. 7, 2006, 4 pgs.
Y. Terao et al., U.S. PTO Offcice Action, Serial No. 11/008,290, Jul. 21, 2006, 15 pgs.

* cited by examiner

WAITING TRAY FOR SHEET PROCESSING TRAY

CROSS-REFERENCE TO RELATED APPLICATIONS

This application is based upon and claims the benefit of priority from prior Japanese Patent Application No. 2004-282214, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function peripheral (MFP).

2. Description of the Related Art

An apparatus called "finisher" is known, which receives printed sheets supplied from an MFP and staples them together. In the finisher, the sheets supplied from the MFP are sequentially conveyed to a tray and stapled by a stapler, forming a bundle of sheets. The bundle of sheets is ejected from the apparatus onto a storage tray.

Jpn. Pat. Appln. KOKAI Publication No. 6-99070 discloses a finisher. This finisher performs a post-process on sheets. In the post-process, a stapler staples sheets. To process the sheets at the same rate as the MFP processes them, it is necessary to reduce the speed at which sheets are conveyed in the finisher. The finisher therefore has a long sheet-conveying path.

Having a long sheet-conveying path, the finisher cannot be as small as desired.

Jpn. Pat. Appln. KOKAI Publications Nos. 11-157724 and 2001-125459 discloses a finisher, too. The finisher has a cover that can be opened to make it easy to remove jamming sheets.

BRIEF SUMMARY OF THE INVENTION

An object of the present invention is to provide a sheet post-process apparatus that can align sheets better than is possible hitherto.

A sheet post-process apparatus according to this invention comprises: a plurality of rollers which receive sheets from an MFP and convey the sheets forward; a waiting tray which is provided in a conveying path and holds the sheets conveyed from the rollers when the sheets need to be post-processed; a processing tray which holds the sheets conveyed from the waiting tray and the sheets conveyed via the conveying path without being conveyed to the waiting tray, before the sheets are post-processed; a conveying mechanism which causes the sheets to fall, due to gravity, from the waiting tray onto the processing tray; a sheet-aligning mechanism which aligns the sheets with one another on the processing tray, at transverse edge and longitudinal edge, thereby forming a bundle of sheets; a post-process mechanism which performs a post-process on the bundle of sheets on the processing tray; sheet-conveying means for conveying the bundle of sheets from the processing tray; a storage tray which holds the bundle of sheets conveyed from the processing tray; and a cover which is provided above the waiting tray and supported to be opened and closed.

Preferably, the apparatus may further comprise a sheet guide which guides the sheets to the waiting tray, a part of the sheet guide being supported to be rotated upwards to an opened position.

It is desired that the cover be a rotatable one.

It is desired that cover be a sliding one.

Preferably, the cover may have a window which can be opened and closed.

In the apparatus, the waiting tray holds sheets to be post-processed. The conveying mechanism causes these sheets to fall, due to gravity, onto the processing tray. Hence, it suffices to provide a sheet-waiting section that is just as long as the waiting tray. This renders the sheet post-process apparatus small.

Since the cover provided above the waiting tray can be opened, jamming sheets, if any, can be easily removed from the post-processing apparatus.

DETAILED DESCRIPTION OF THE INVENTION

An embodiment of this invention will be described, with reference to the accompanying drawings.

Figure 1:
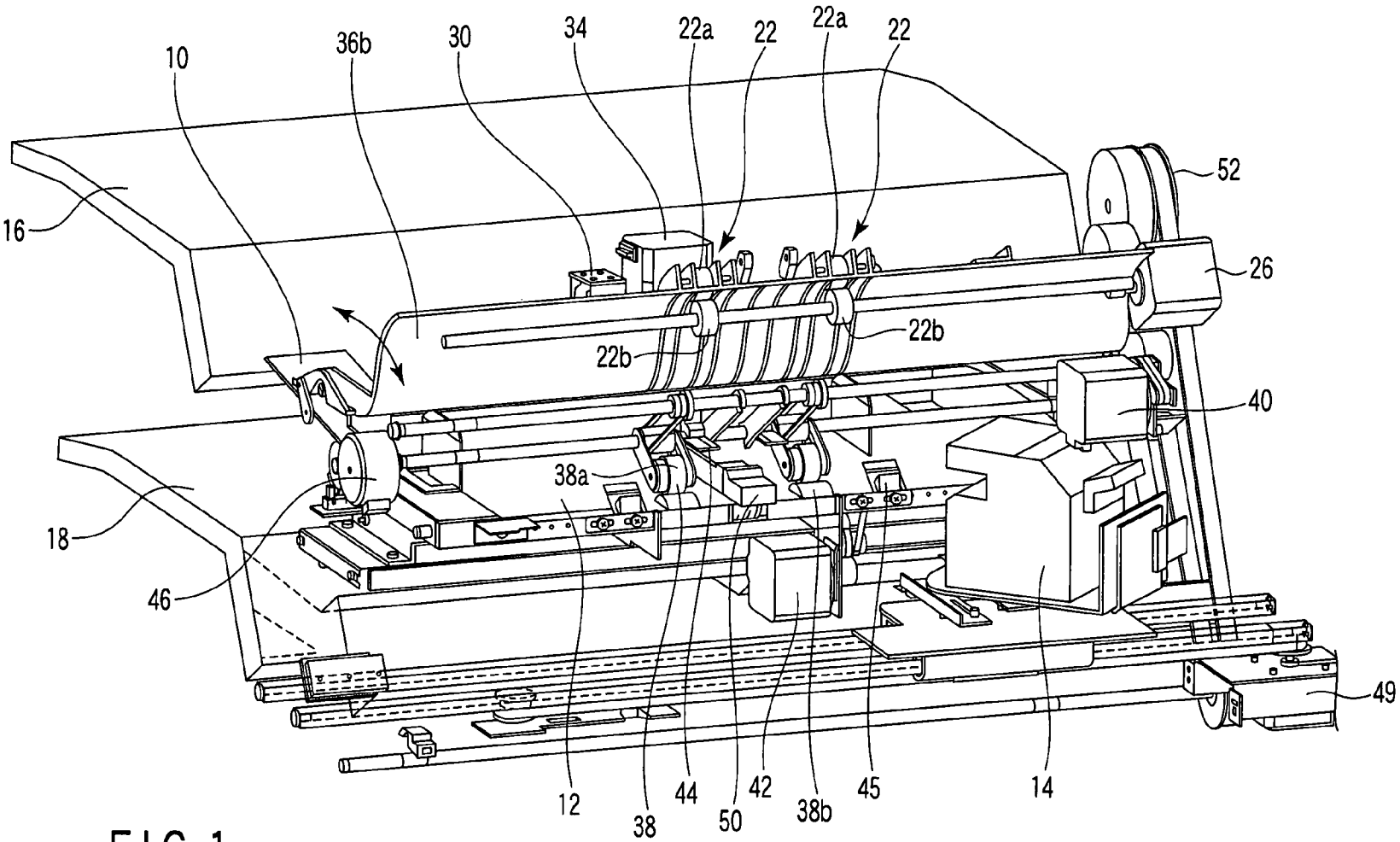
FIG. 1 is a perspective view of a post-process apparatus according to this invention.
Figure 2:
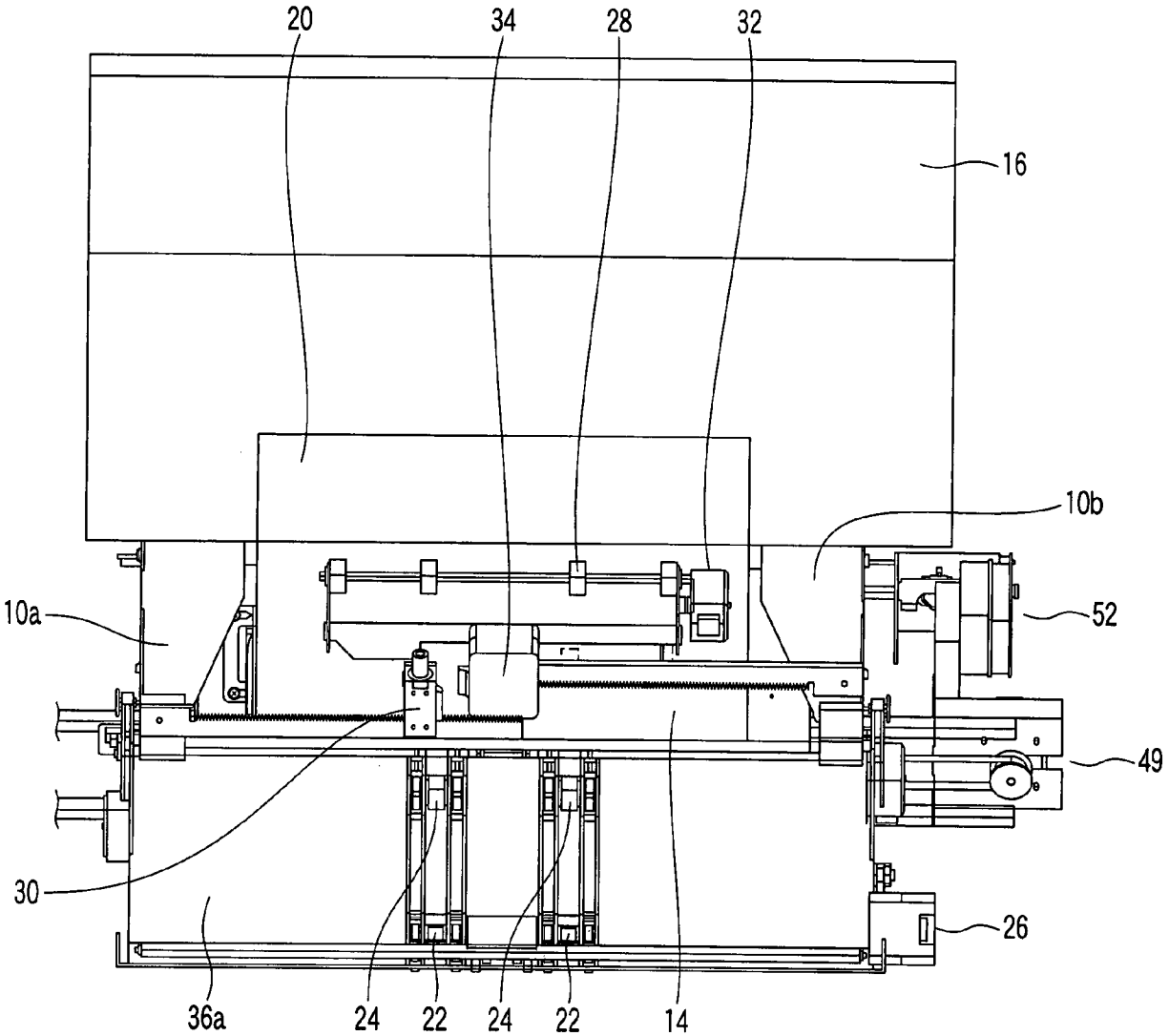
FIG. 2 is a top view of the post-process apparatus according to the invention.

FIG. 1 is a perspective view of a sheet post-process apparatus according to this invention. FIG. 2 is a top view of the post-process apparatus. As FIG. 1 shows, the post-process apparatus comprises a waiting tray 10, a processing tray 12, a stapler 14, a first storage tray 16, and a second storage tray 18.

The sheet post-process apparatus further comprises a pair of input rollers 22, a pair of sheet-feeding rollers 24, and an input-roller motor 26. The input rollers 22 receive a sheet 20 supplied from an MFP and convey the sheet 20 to the sheet-feeding rollers 24. The sheet-feeding rollers 24 convey the sheet 20 to the waiting tray 10. The input-roller motor 26 drives the input rollers 22.

One of the input rollers 22 is an upper input roller 22*a*, and the other input roller 22 is a lower input roller 22*b*. Likewise, one of the sheet-feeding rollers 24 is an upper sheet-feeding roller, and the other sheet-feeding roller 24 is a lower sheet-feeding roller.

The waiting tray 10 comprises two tray parts 10*a* and 10*b*. The tray parts 10*a* and 10*b* can move from left to right, and vice versa. When the tray parts 10*a* and 10*b* take a closed position, the waiting tray 10 can receive sheets. Waiting-tray rollers 28, a waiting-roller drive 30 and a waiting-roller motor 32 are provided. The waiting-tray rollers 28 align sheets on the tray parts 10*a* and 10*b* while both tray parts remain in the closed position. The waiting-tray rollers 28 can move up and down when they are driven and controlled by the waiting-roller drive 30. The waiting-roller motor 32 rotates the waiting-tray rollers 28.

Figure 3:
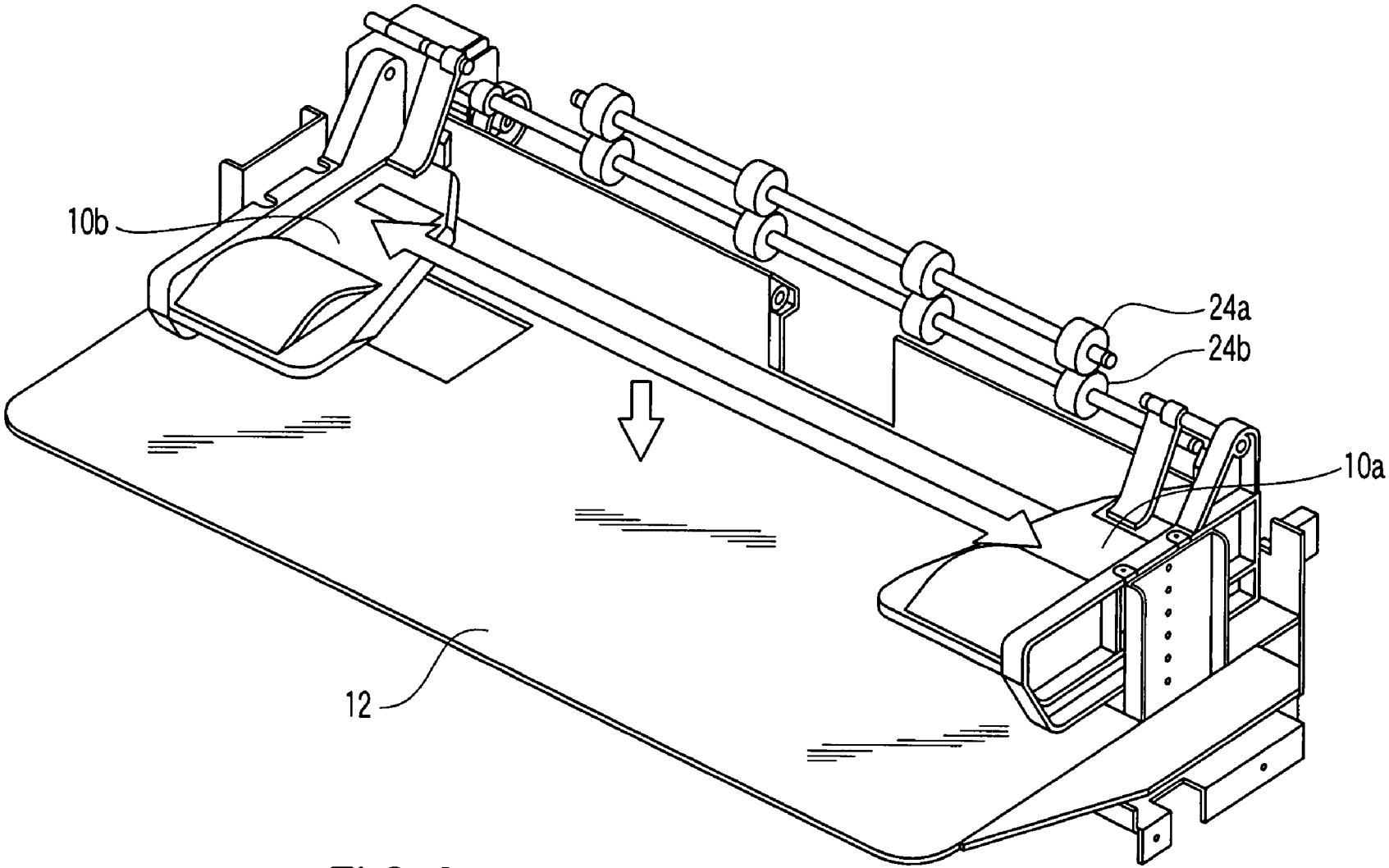
FIG. 3 is a perspective view illustrating how the waiting tray of the post-process apparatus performs its function.

When the number of sheets 20 stacked on the waiting tray 10 reaches a prescribed value, a waiting-tray motor 34 drives the waiting-tray parts 10*a* and 10*b* to an opened position as is illustrated in FIG. 3. The sheets 20 fall onto the processing tray 12, due to gravity. This event is known as "active drop."

The sheet post-process apparatus has a paper guide 36, which guides sheets from the MFP to the waiting tray 10 and thence to the processing tray 12. The paper guide 36 has an upper conveying guide 36*a* and a lower conveying guide 36*b*.

Figure 4:
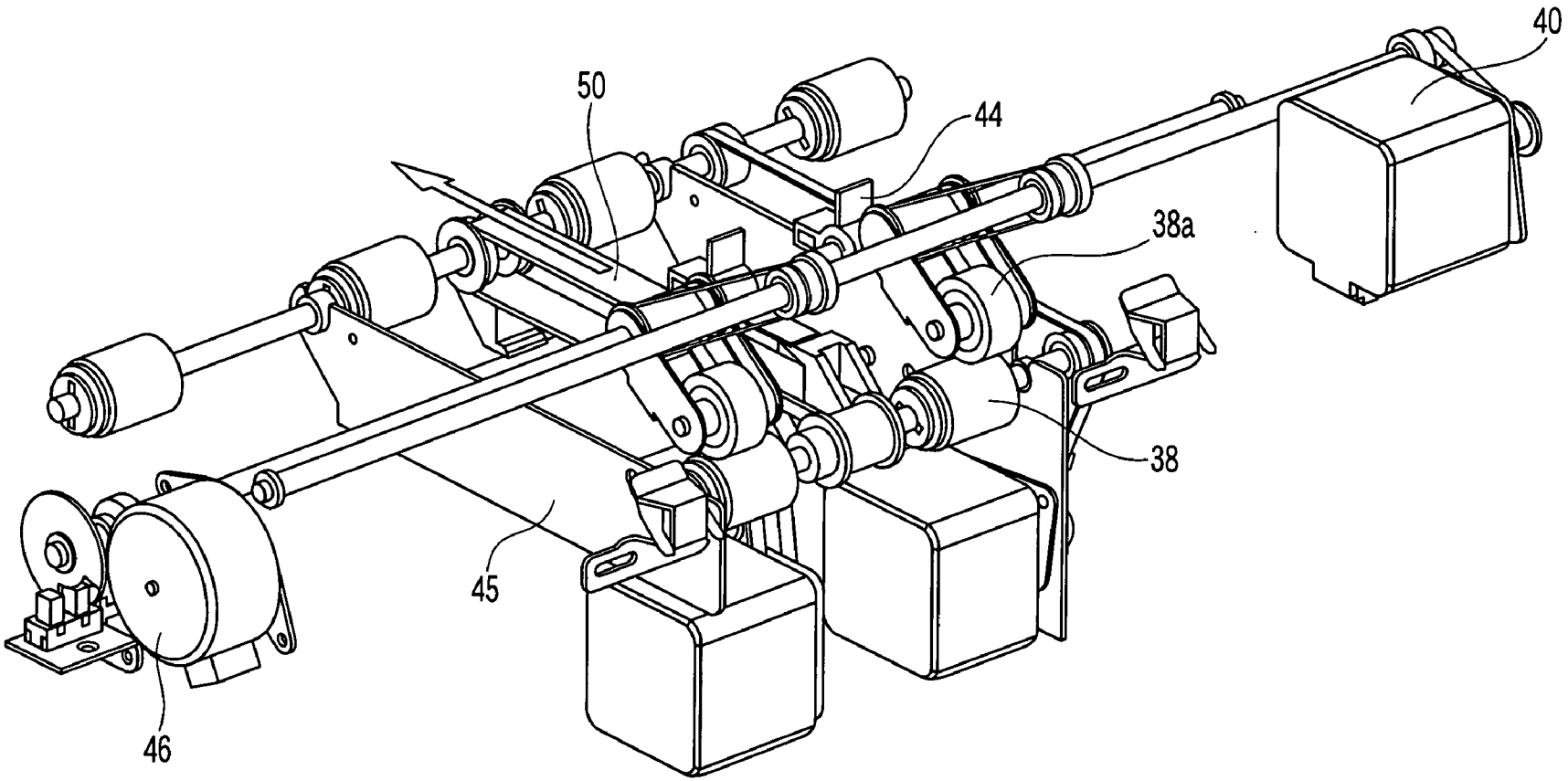
FIG. 4 is a perspective view depicting the sheet-bundle conveying mechanism provided in the post-process apparatus, and explaining how sheets are aligned at longitudinal edges in the post-process apparatus.

In the processing tray 12, the sheets are aligned at the longitudinal edges and the transverse edges. The sheets are aligned at their longitudinal edges by a longitudinal-alignment mechanism 38 as is illustrated in FIG. 4. More precisely, an upper longitudinal-alignment motor 40 drives the upper longitudinal-alignment rollers 38*a* of the mechanism 38, and a lower longitudinal-alignment motor 42 drives the lower longitudinal-alignment rollers 38*b* of the mechanism 38. Driven by the motors 40 and 42, the rollers 38*a* and 38*b* move the sheets until one longitudinal edge of every sheet abuts on a stopper 45. Paddles 44 are provided to facilitate the longitudinal alignment. A paddle motor 46 drives the paddles 44.

Figure 5:
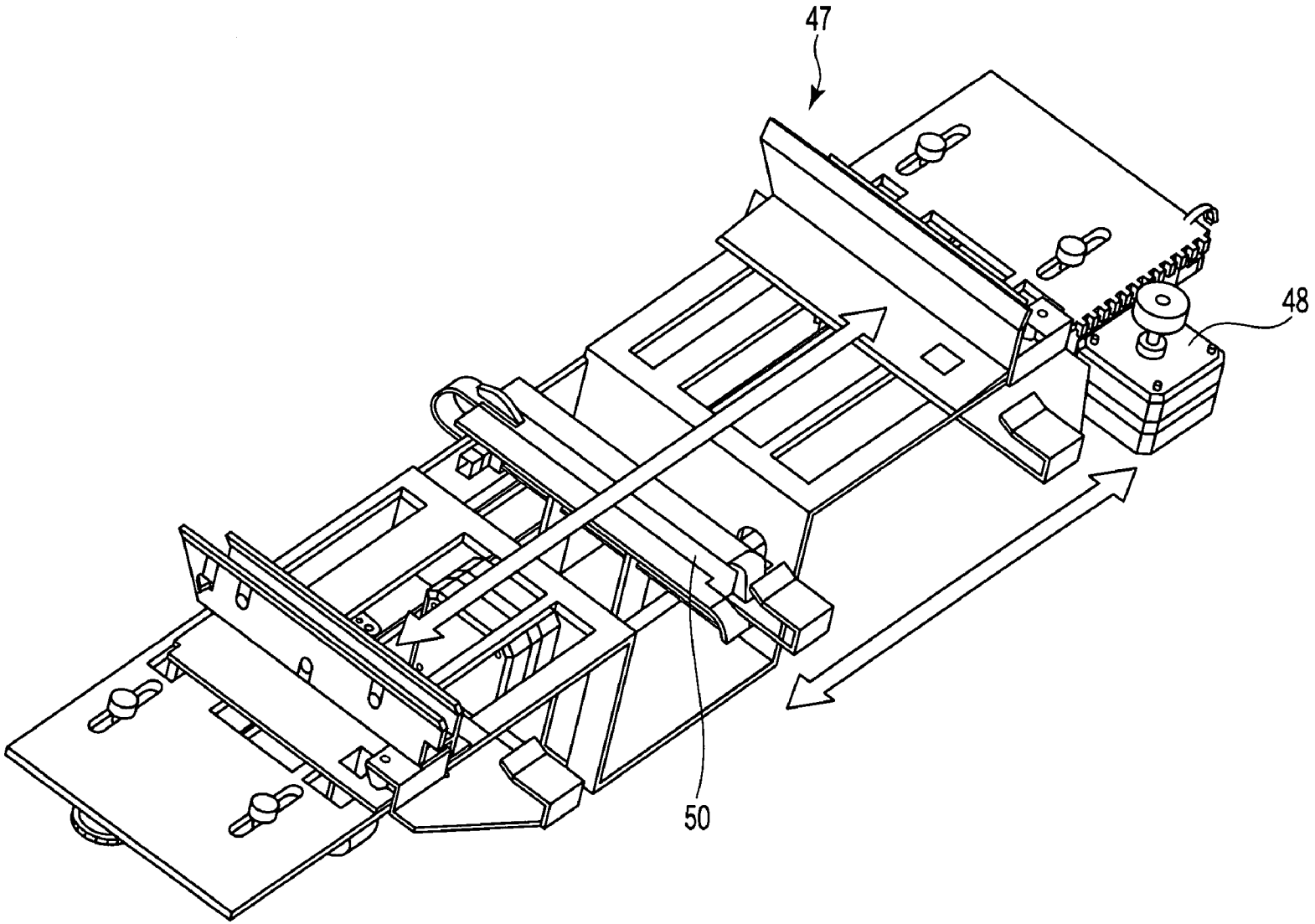
FIG. 5 is a perspective view showing the mechanism for aligning sheets at their transverse edges.

The sheets are aligned at their transverse edges, too, as is illustrated in FIG. 5. More specifically, the transverse alignment is performed by a transverse-alignment mechanism 47 and a transverse-alignment motor 48.

Figure 6:
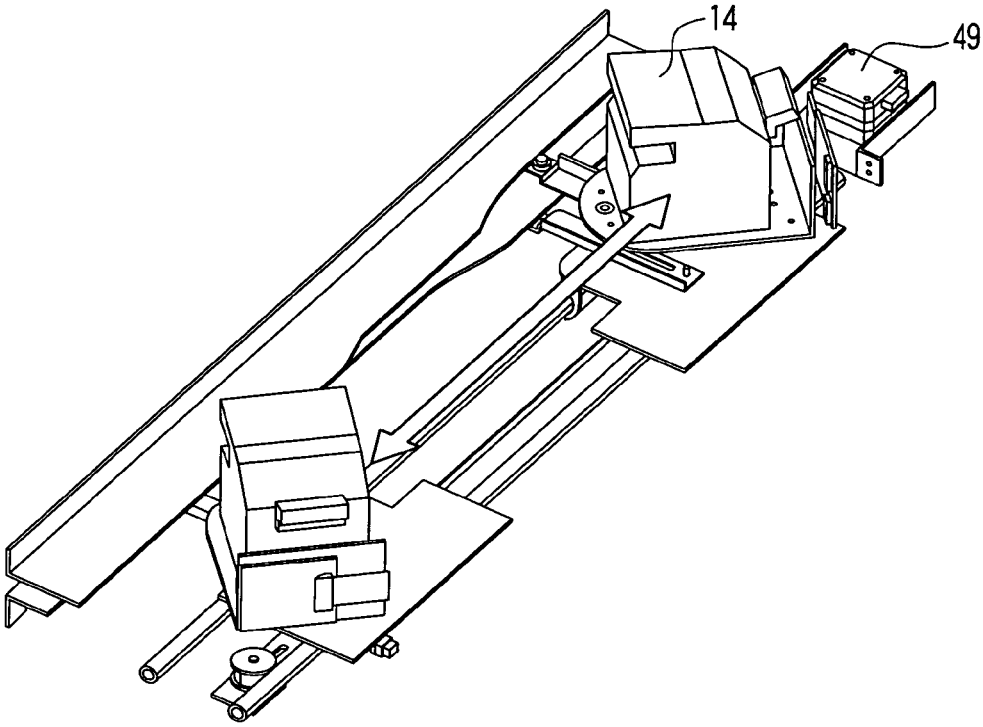
FIG. 6 is a perspective view illustrating how the stapler provided in the post-process apparatus performs its function.

When the number of sheets thus aligned in the processing tray 12 reaches the prescribed value, the stapler 14 starts operating. The stapler 14 is positioned as depicted in FIG. 6 and controlled by a stapler-driving unit 49.

Controlled by the unit 49, the stapler 14 staples the sheets together, forming a bundle of sheets. As shown in FIG. 4, a transport mechanism 50 transports the bundle of sheets to the first storage tray 16. Either the first storage tray 16 or the second storage tray 18 is selected when a storage-tray driving unit 52 (FIG. 2) moves the tray 16 or 18 to a predetermined upper position.

How the post-process apparatus according to this invention operates will be explained with reference to FIGS. 7 to 17.

Figure 7:
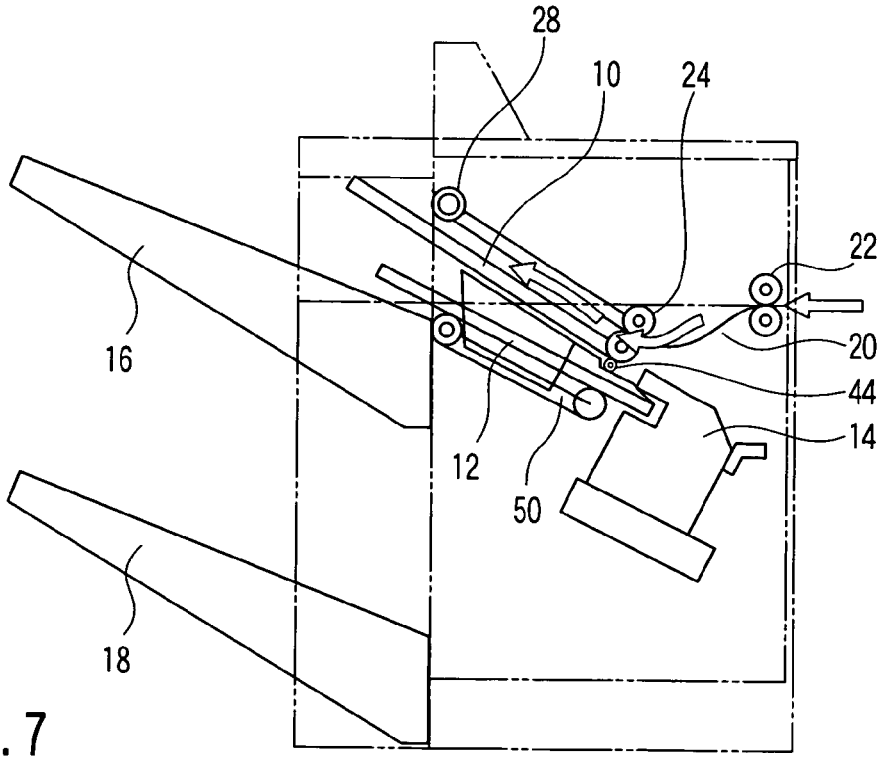
FIG. 7 is a sectional view of the post-process apparatus, showing how the first sheet moves from the input rollers to the sheet-feeding roller.

As FIG. 7 shows, a sheet 20 conveyed from the MFP is moved from the input rollers 22 to the sheet-feeding rollers 24, in the direction of the arrow.

Figure 8:
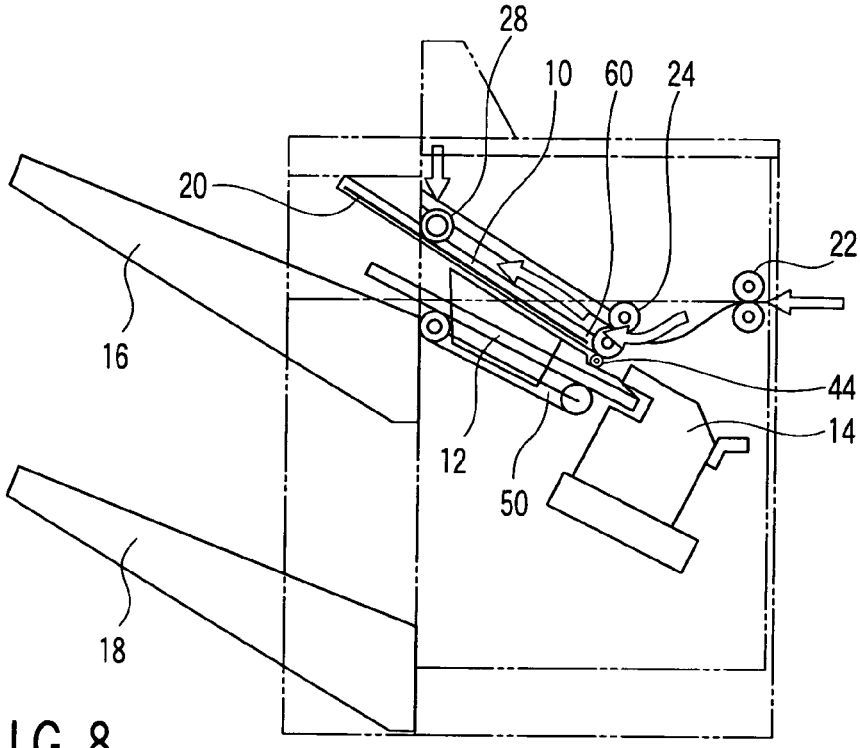
FIG. 8 is a sectional view of the apparatus, explaining how the first sheet moves from the sheet-feeding rollers to the waiting tray.

As is illustrated in FIG. 8, the sheet 20, or the first sheet, is placed on the waiting tray 10. Then, the waiting-tray rollers 28 move down, in the direction of the arrow, aligning the trailing edge of the first sheet 20 at the rear (i.e., upstream) end 60 of the waiting tray 10.

Figure 9:
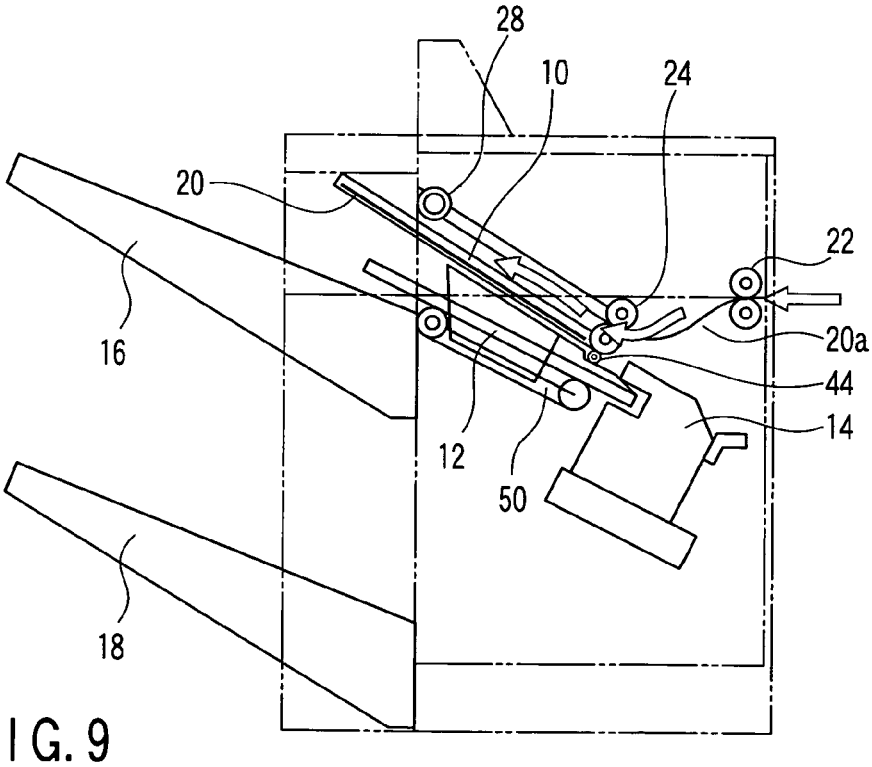
FIG. 9 is a sectional view of the apparatus, explaining how the second sheet moves from the sheet-feeding rollers to the waiting tray.

As FIG. 9 depicts, the waiting-tray rollers 28 moves up to receive the second sheet 20*a*.

Figure 10:
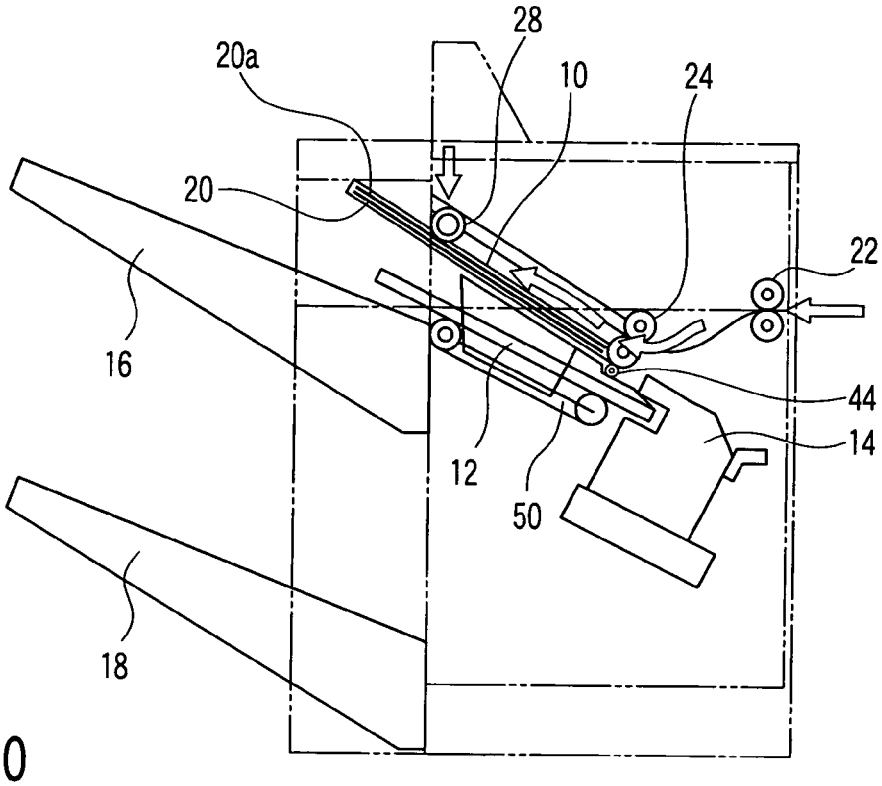
FIG. 10 is a sectional view of the post-process apparatus, showing how the waiting-tray rollers operate.

As FIG. 10 shows, the second sheet 20 is conveyed to the waiting tray 10. The waiting-tray rollers 28 move down, aligning the trailing edge of the second sheet 20*a* at the rear end 60 of the waiting tray 10. Thus, a bundle 20*b* of two sheets 20 and 20*a* is formed in the waiting tray 10.

Figure 11:
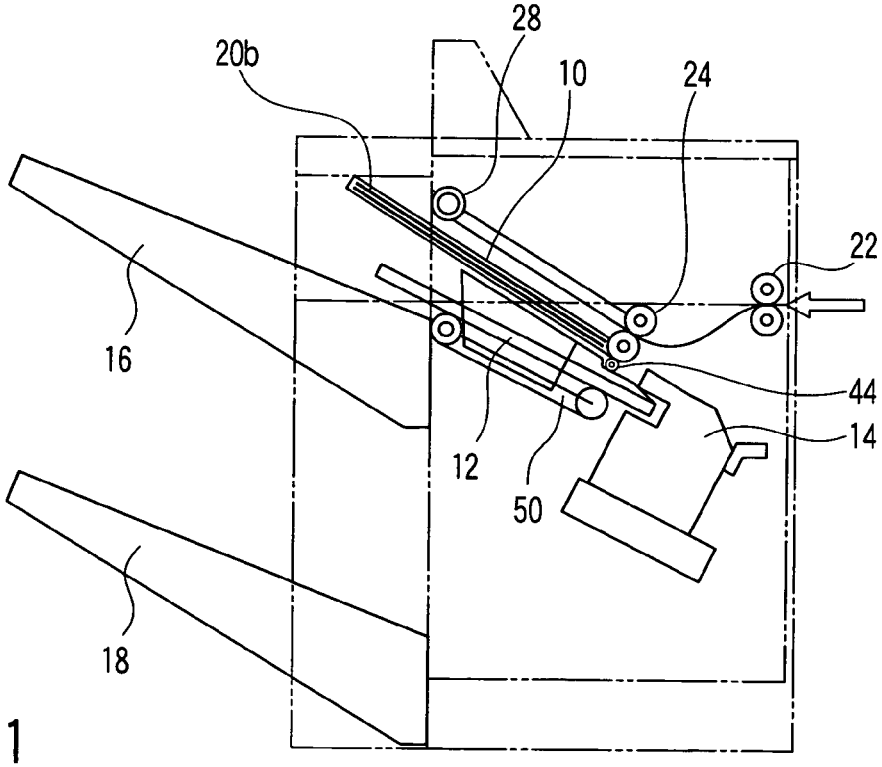
FIG. 11 is another sectional view of the apparatus, illustrating how the waiting-tray rollers operate.
Figure 12:
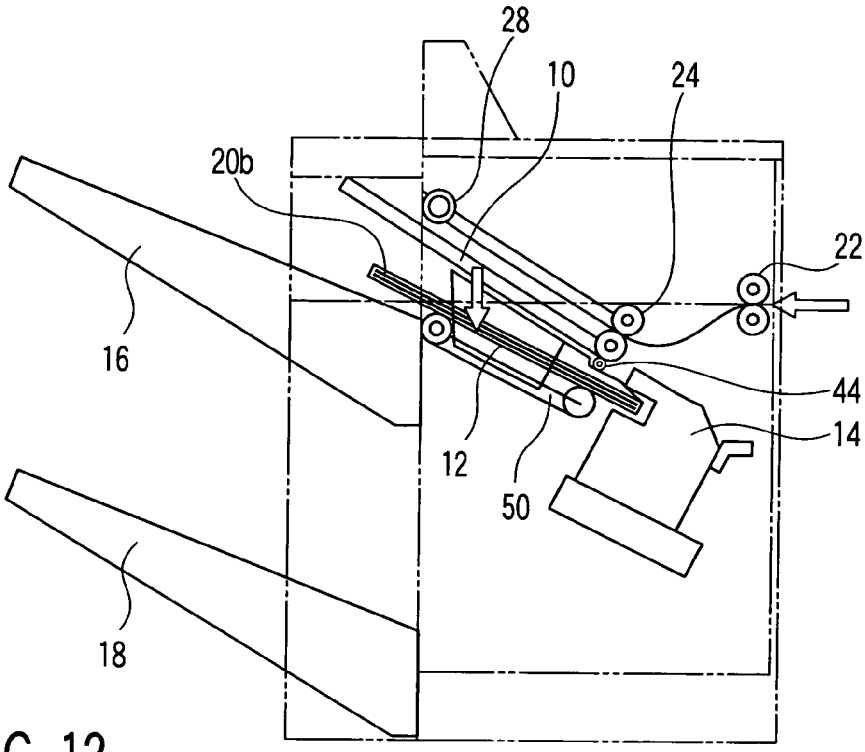
FIG. 12 is a sectional view of the apparatus, explaining how an active drop is carried out.

As FIG. 11 shows, the waiting-tray rollers 28 move upwards. Then, the waiting-tray parts 10*a* and 10*b* move to the opened position as is illustrated in FIG. 3. The active drop is therefore performed as shown in FIG. 12. The bundle 20*b* is conveyed to the processing tray 12.

Thereafter, the third sheet 20*c* and some following sheets are conveyed from the sheet-feeding rollers 24 to the processing tray 12, not through the waiting tray 10. These sheets are laid, one after another, upon the bundle 20*b* of two sheets. A bundle 21, which consists of the prescribed number of sheets, is formed on the processing tray 12. As the sheets including the third sheet 20 are sequentially laid on the bundle 20*b*, the longitudinal-alignment rollers 38 and the transverse-alignment mechanism 47 align the sheets at their longitudinal edges and transverse edges.

Figure 13:
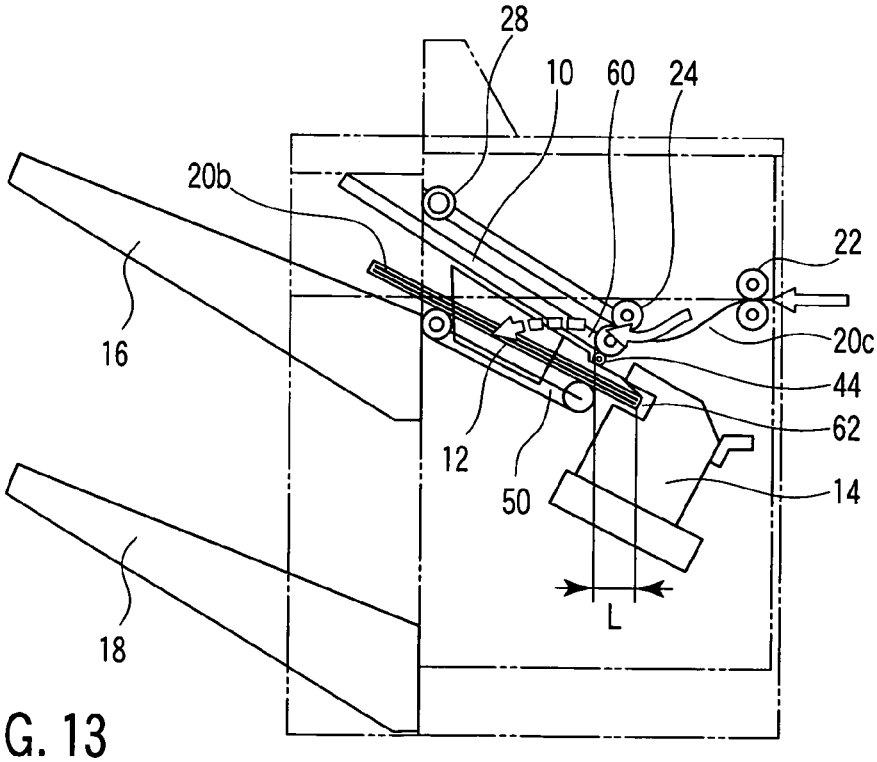
FIG. 13 is a sectional view of the apparatus, explaining how the third sheet is conveyed.

The waiting tray 10 must be positioned so that its rear end 60 may lie downstream of the rear end (upstream-side) of the processing tray 12 when the sheets are laid on the bundle 20*b*. As shown in FIG. 13, the rear end 60 of the waiting tray 10 is therefore spaced from the rear end 62 of the processing tray 12, by distance L, in the transverse direction. This enables the bundle 20*b* to fall smoothly from the waiting tray 10 onto the processing tray 12. This also makes it easy for both alignment mechanisms 38 and 47 to align sheets. Thus, jamming of sheets can be prevented.

It is desired that the waiting tray 10 and the processing tray 12 be inclined, having their upstream ends at a lower position than their downstream ends. In other words, they should be so positioned that their rear ends 60 and 62 lie at the lowest position. If the trays 10 and 12 are so inclined, the sheets 20 are aligned, due to gravity, at the rear end 60 of the waiting tray 10, and the bundle 20*b* can be aligned, due to gravity, at the rear end and 62 of the processing tray 12.

As seen from FIGS. 10 to 13, the sheet post-process apparatus has the following three characterizing features:

(1) The waiting tray 10 extends longer in the sheet-conveying direction than the length of sheets 20.

(2) The processing tray 12 extends shorter in the sheet-conveying direction than the length of sheets 20.

(3) Because of the feature (2), any sheet 20 that has fallen from the waiting tray 10 onto the processing tray 12 is supported not only by the processing tray 12, but also by the first storage tray 16.

These features (1), (2) and (3) reduce the size of the sheet post-process apparatus (i.e., finisher) in the sheet-conveying direction.

Figure 14:
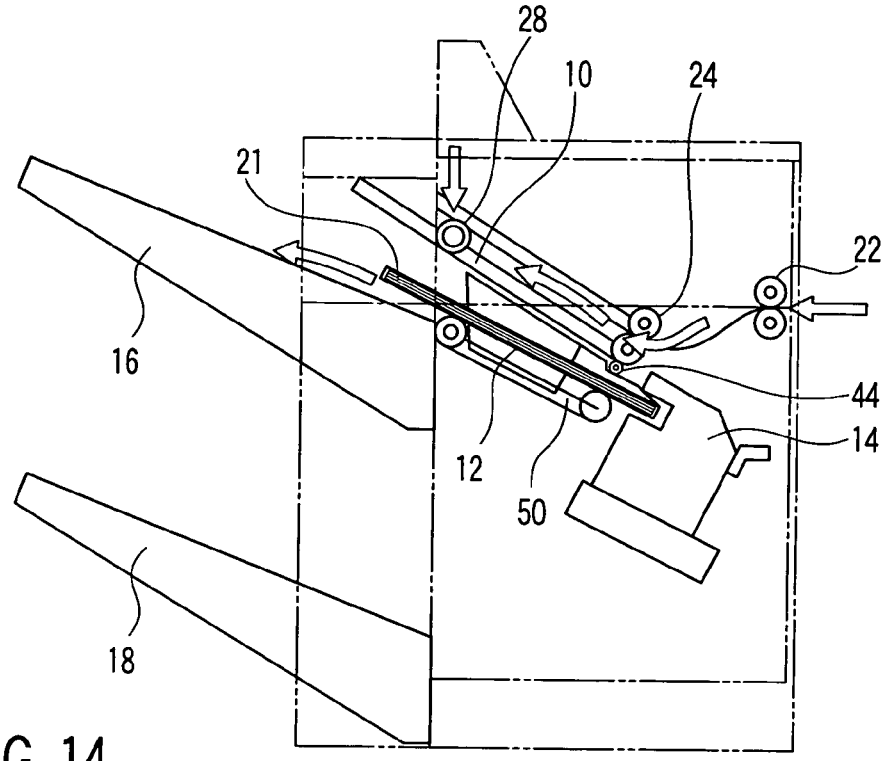
FIG. 14 is a sectional view of the apparatus, illustrating how the stapler operates.
Figure 15:
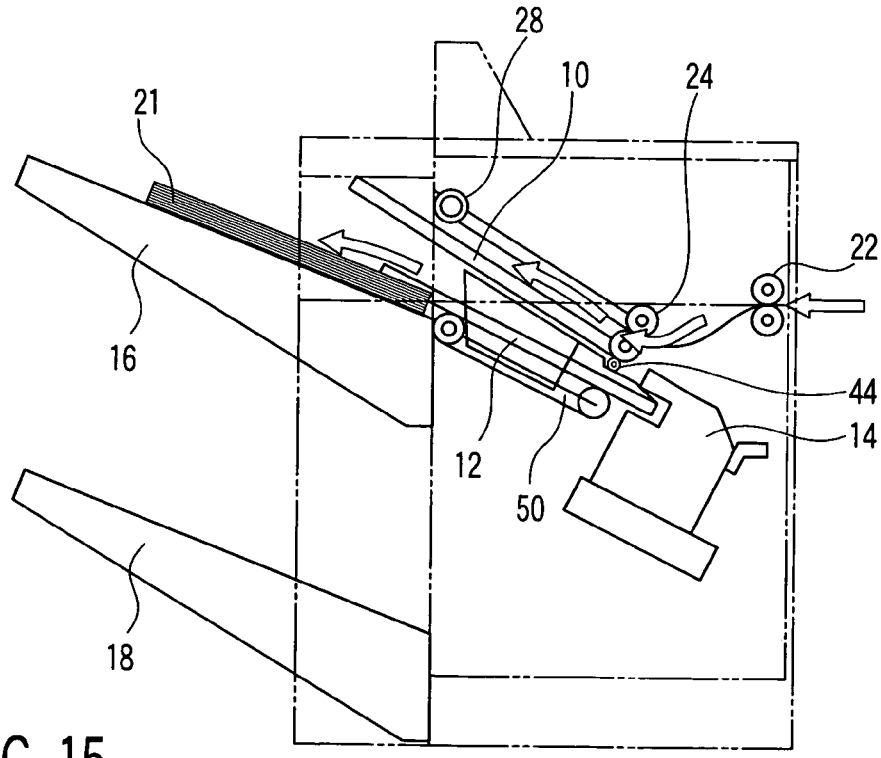
FIG. 15 is a sectional view of the apparatus, explaining how a bundle of sheets moves between the processing tray and the storage tray.

As FIG. 14 shows, the stapler 14 staples the bundle 21 of sheets. Then, the transport mechanism 50 transports the bundle 21 to the storage tray 16 as illustrated in FIG. 15. Thus, the post-process ends.

Figure 16:
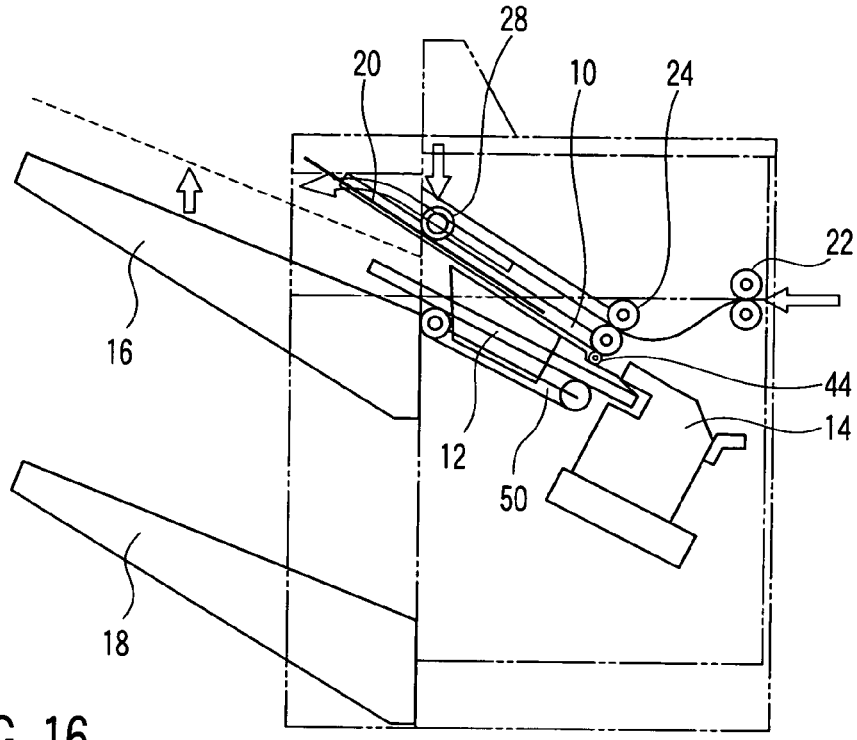
FIG. 16 is a sectional view of the apparatus, illustrating how sheets move from the waiting tray to the storage tray.
Figure 17:
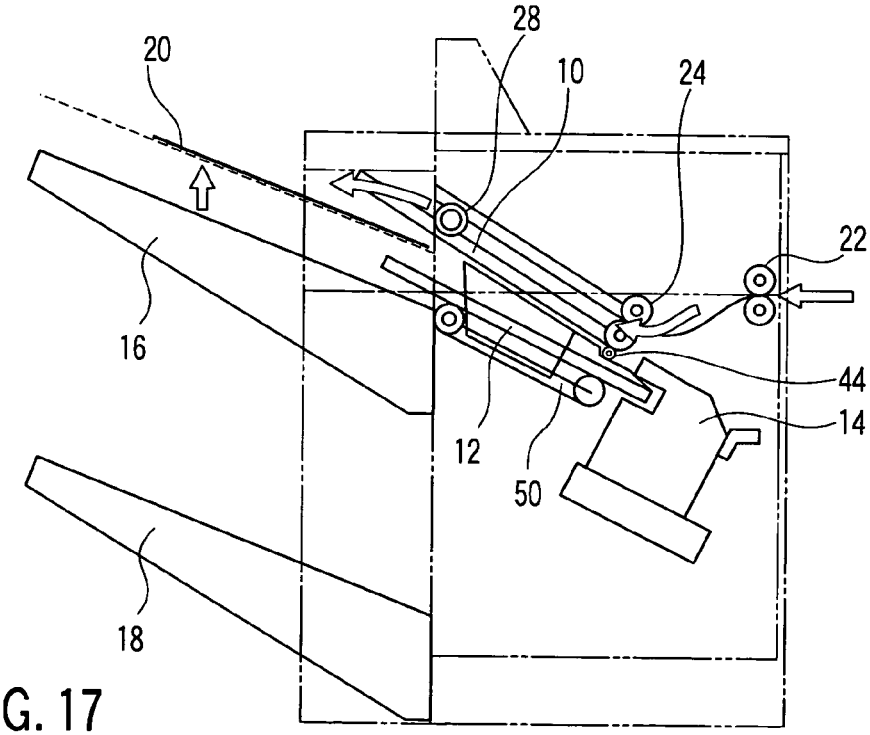
FIG. 17 is a sectional view of the apparatus, explaining how the position of the storage tray is changed.

If the sheets need not undergo the post-process, they are not conveyed to the processing tray 12. They are ejected from the waiting tray 10 onto the first storage tray 16 as shown in FIGS. 16 and 17. As FIG. 16 shows, the sheets supplied from the MFP are sequentially conveyed to the first storage tray 16 via the input rollers 22, sheet-feeding rollers 24 and waiting tray 10. The waiting-tray rollers 28 move down, serving to convey sheets 20. As depicted in FIG. 17, the storage-tray driving unit 52 lifts the first storage tray 16 a little and receives the sheets coming from the waiting tray 10.

The post-process apparatus has a top cover 70, which will be described with reference to FIG. 18.

In the post-process apparatus has the waiting tray 10, processing tray 12 and mechanism for causing sheets 20 to fall, due to gravity, from the waiting tray 10 onto the processing tray 12, the sheet are likely to jam with one another, particularly at the waiting tray 10. To facilitate the removal of jamming sheets, if any, from the apparatus, the top cover 70 provided above the waiting tray 10 can be opened. When the user rotates the top cover 70 upwards, thus opening the cover 70, he or she can have easy access to the jamming sheets. A support 68 is provided on the top of the apparatus, to hold the top cover 70 in the opened position.

Figure 18:
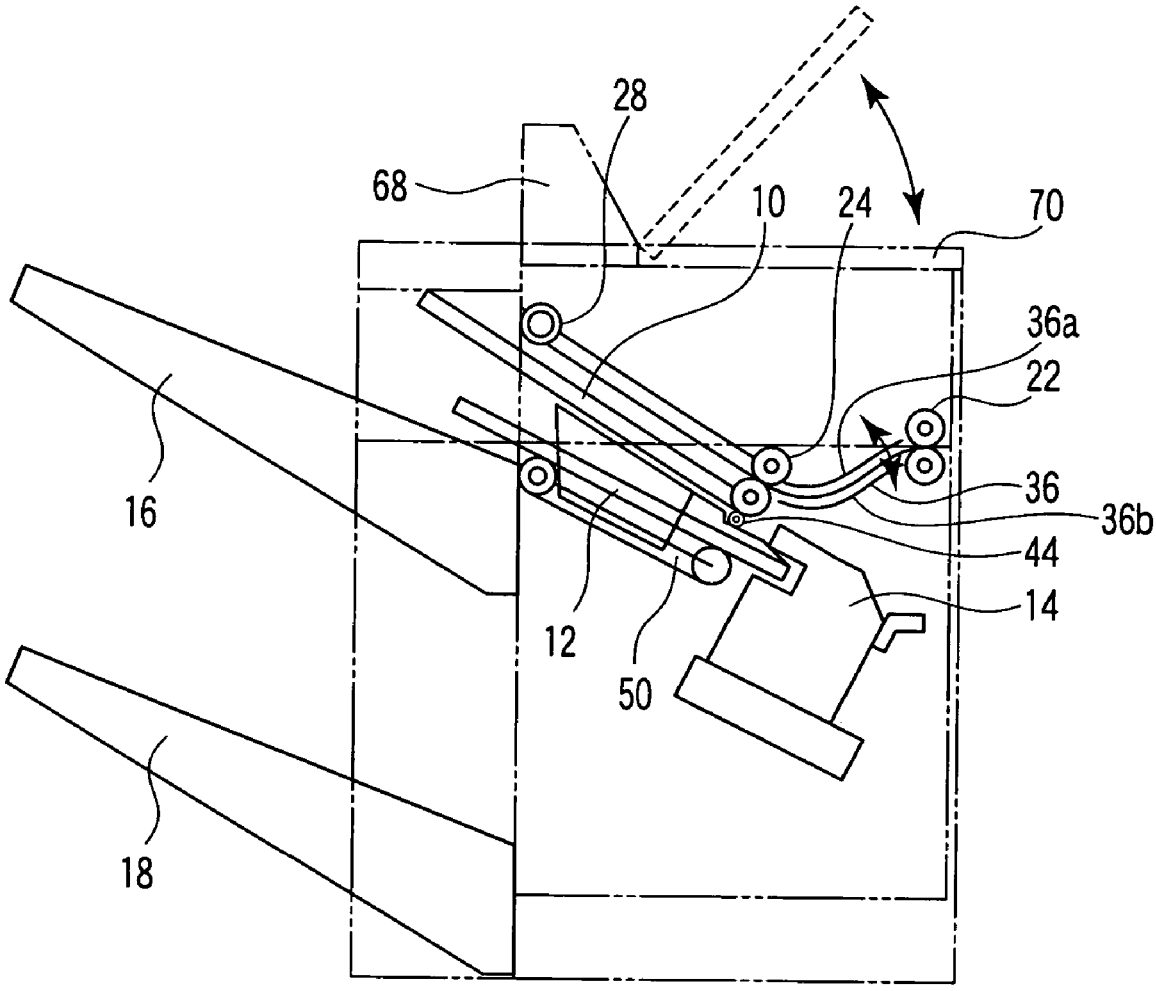
FIG. 18 is a sectional view, explaining how the paper guide and the top cover are moved.

As FIGS. 3 and 18 shows, the paper guide 36 extends from the input rollers 22 to the sheet-feeding roller 24. The upper conveying guide 36*a* can be rotated upwards to an opened position. Should sheets jam with one another in the paper guide 36, the user may opens the top cover 70 and then the upper conveying guide 36*a*. Thus, the jamming sheets can be easily removed from the post-process apparatus.

Figure 19:
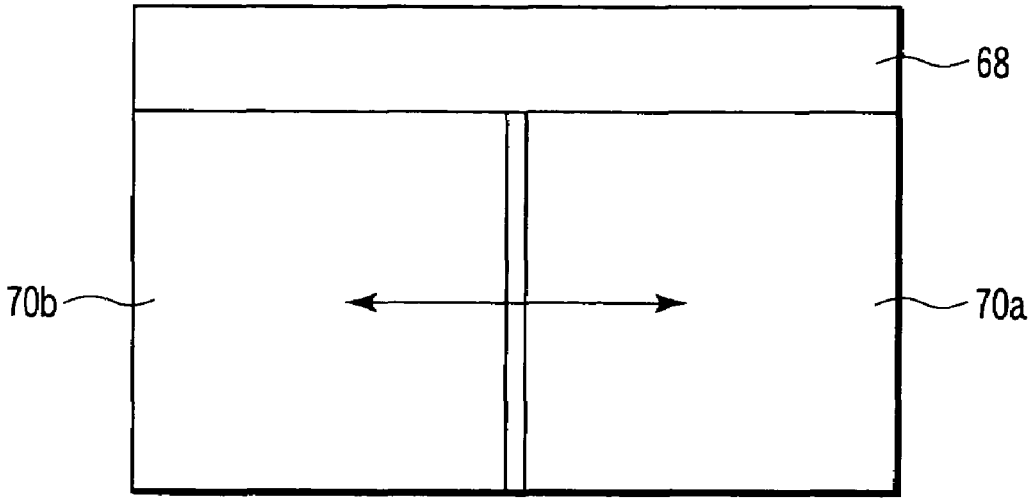
FIG. 19 is a diagram showing a modification of the top cover.
Figure 20:
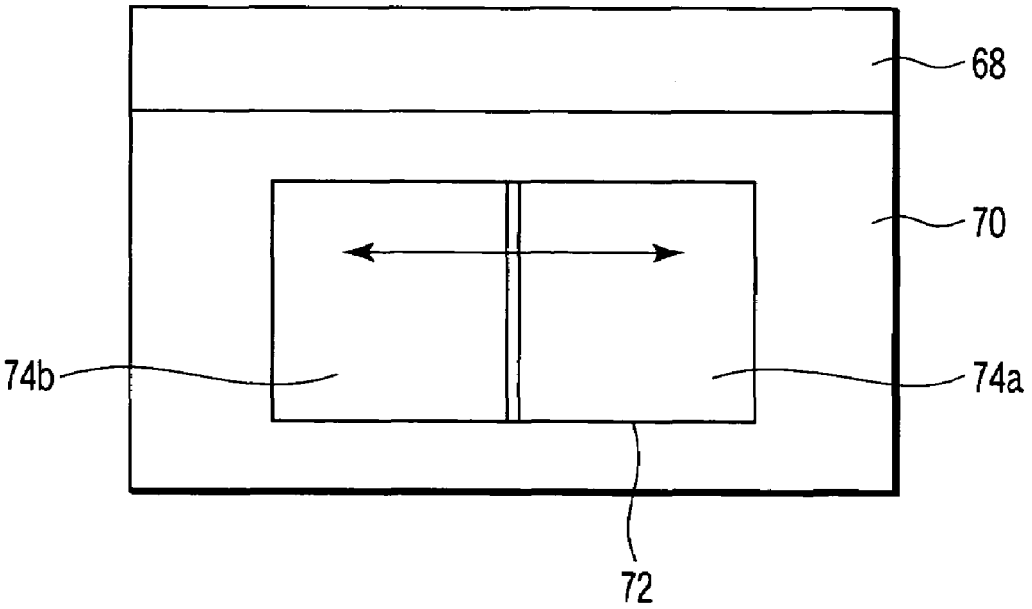
FIG. 20 is a diagram depicting another modification of the top cover.

The top cover 70 may be not be rotated upwards to be opened, as shown in FIG. 18. Instead, the top cover 70 may comprise two sliding cover members 70*a* and 70*b* as illustrated in FIG. 19. Further, the top cover 70 may have a window 72 as shown in FIG. 20. In this case, two window-panes 74*a* and 74*b* are set in the window 72. The window-panes 74*a* and 74*b* may be slid or rotated to be opened and closed.

One embodiment of the invention has been described. The invention is not limited to the embodiment, nevertheless. The components described above may be replaced with other components that are identical in function.

What is claimed is:

1. A sheet post-process apparatus, comprising:

a plurality of rollers which receive sheets from a multi-function peripheral and convey the sheets forward;

a waiting tray which is provided in a conveying path and holds some of the sheets conveyed from the rollers when a bundle of sheets needs to be post-processed;

a processing tray which holds the sheets conveyed from the waiting tray and other sheets forming the bundle of sheets before the bundle of sheets is post-processed;

a post-process mechanism which performs a post-process on the bundle of sheets on the processing tray;

a storage tray which holds the bundle of sheets conveyed from the processing tray; and a cover member which is provided above the waiting tray and opposite to the storage tray in a horizontal direction in a non-overlapping manner, and supported to be opened and closed.

2. The sheet post-process apparatus according to claim 1, further comprising a sheet guide which guides the sheets to the waiting tray, a part of said sheet guide being supported to be rotated upwards to an opened position.

3. The sheet post-process apparatus according to claim 1, further comprising a support member to hold the cover member in an opened position.

4. The sheet post-process apparatus according to claim 3, wherein the cover member is rotated upwards and abuts the support member in the opened position.

5. The sheet post-process apparatus according to claim 3, wherein the support member is provided between the cover member and the storage tray in the horizontal direction.

6. The sheet post-process apparatus according to claim 1, wherein the cover member includes two sliding members operable such that the cover member takes opened and closed positions.

7. The sheet post-process apparatus according to claim 1, wherein the cover member has a window which can be opened and closed.

8. The sheet post-process apparatus according to claim 1, further comprising a sheet-conveying mechanism which conveys the post-processed bundle of sheets from the processing tray to the storage tray.

9. The sheet post-process apparatus according to claim 1, wherein the processing tray holds the other sheets conveyed via the conveying path without being conveyed to the waiting tray before the bundle of sheets is post-processed.

10. The sheet post-process apparatus according to claim 1, further comprising a sheet-aligning mechanism which aligns the bundle of sheets with one another on the processing tray at transverse and longitudinal edges.

11. A sheet post-process apparatus, comprising:

a plurality of rollers which receive sheets from a multi-function peripheral and convey the sheets forward;

a waiting tray which is provided in a conveying path and holds some of the sheets conveyed from the rollers when a bundle of sheets needs to be post-processed;

a processing tray which holds the sheets conveyed from the waiting tray and other sheets forming the bundle of sheets, before the bundle of sheets is post-processed;

a post-process mechanism which performs a post-process on the bundle of sheets on the processing tray;

a storage tray which holds the bundle of sheets conveyed from the processing tray; and means for covering provided above the waiting tray and opposite to the storage tray in a horizontal direction in a non-overlapping manner, and supported to be opened and closed.

12. The sheet post-process apparatus according to claim 11, further comprising a sheet guide which guides the sheets to the waiting tray, a part of said sheet guide being supported to be rotated upwards to an opened position.

13. The sheet post-process apparatus according to claim 11, further comprising a support member to hold the cover member in an opened position.

14. The sheet post-process apparatus according to claim 13, wherein the cover member is rotated upwards and abuts the support member in the opened position.

15. The sheet post-process apparatus according to claim 13, wherein the support member is provided between the cover member and the storage tray in the horizontal direction.

16. The sheet post-process apparatus according to claim 11, wherein the cover member includes two sliding members operable such that the cover member takes opened and closed positions.

17. The sheet post-process apparatus according to claim 11, wherein the cover member has a window which can be opened and closed.

18. The sheet post-process apparatus according to claim 11, further comprising a sheet-conveying mechanism which conveys the post-processed bundle of sheets from the processing tray to the storage tray.

19. The sheet post-process apparatus according to claim 11, wherein the processing tray holds the other sheets conveyed via the conveying path without being conveyed to the waiting tray before the bundle of sheets is post-processed.

20. The sheet post-process apparatus according to claim 11, further comprising a sheet-aligning mechanism which aligns the bundle of sheets with one another on the processing tray at transverse and longitudinal edges.

* * * * *